US006703175B2

(12) United States Patent
Ebisu et al.

(10) Patent No.: US 6,703,175 B2
(45) Date of Patent: Mar. 9, 2004

(54) COLOR TONER CONTAINING LESS CONDUCTIVE PARTICLES THAT HAVE APPROPRIATE ELECTRICAL RESISTANCE AND CAN PRODUCE CLEAR COLOR IMAGES

(75) Inventors: Katsuji Ebisu, Kawasaki (JP); Yuzo Horikoshi, Kawasaki (JP); Takahiro Kashikawa, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 29 days.

(21) Appl. No.: 10/101,051

(22) Filed: Mar. 20, 2002

(65) Prior Publication Data

US 2003/0059698 A1 Mar. 27, 2003

(30) Foreign Application Priority Data

Sep. 27, 2001 (JP) ..... 2001-296645

(51) Int. Cl.[7] ..... G03G 9/14

(52) U.S. Cl. ..... 430/108.6; 430/111.41; 399/252

(58) Field of Search ..... 430/108.6, 111.41; 399/252

(56) References Cited

U.S. PATENT DOCUMENTS

| | | | | |
|---|---|---|---|---|
| 2,297,691 | A | | 10/1942 | Carlson |
| 5,830,616 | A | * | 11/1998 | Yaguchi et al. ..... 430/111.41 |

FOREIGN PATENT DOCUMENTS

| | | | |
|---|---|---|---|
| JP | 59-200250 | | 11/1984 |
| JP | 60-004949 | | 1/1985 |
| JP | 62-015559 | | 1/1987 |
| JP | 63233016 | A | 9/1988 |
| JP | 63-271473 | | 9/1988 |
| JP | 01215357 | A | 8/1989 |
| JP | 02153068 | A | 6/1990 |
| JP | 02170860 | A | 7/1990 |
| JP | 03-068957 | | 3/1991 |
| JP | 04134468 | A | 5/1992 |
| JP | 04349120 | A | 12/1992 |
| JP | 05-019525 | | 1/1993 |
| JP | 06-332232 | | 2/1994 |
| JP | 06183737 | A | 7/1994 |
| JP | 06207118 | A | 7/1994 |
| JP | 06279618 | A | 10/1994 |
| JP | 06338213 | A | 12/1994 |
| JP | 06348063 | A | 12/1994 |
| JP | 07053217 | A | 2/1995 |
| JP | 08054739 | A | 2/1996 |
| JP | 08087129 | A | 4/1996 |
| JP | 08227235 | A | 9/1996 |
| JP | 08234479 | A | 9/1996 |
| JP | 08240882 | A | 9/1996 |
| JP | 08334864 | A | 12/1996 |
| JP | 09059492 | A | 3/1997 |
| JP | 09-204072 | | 8/1997 |
| JP | 09-299748 | | 11/1997 |
| JP | 10142737 | A | 5/1998 |
| JP | 10147891 | A | 6/1998 |
| JP | 11038732 | A | 2/1999 |
| JP | 11316440 | A | 11/1999 |
| JP | 2000003073 | A | 1/2000 |
| JP | 2000010350 | A | 1/2000 |
| JP | 2000017231 | A | 1/2000 |
| JP | 2000221733 | A | 8/2000 |
| JP | 2000-267337 | | 9/2000 |
| JP | 2001060014 | A | 3/2001 |

* cited by examiner

*Primary Examiner*—Mark A. Chapman
(74) *Attorney, Agent, or Firm*—Westerman, Hatttori, Daniels & Adrian LLP

(57) ABSTRACT

A color toner for electrophotography containing less conductive particles that have appropriate electrical resistance and an aspect ratio can produce clear color images. Specifically, the conductive particles contained in the color toner having an electrical resistance of 1–100 Ω·cm, an aspect ratio of 10 or more, and a major axis length of 4 μm or less that are distributed in the binding resin of the color toner at a weight percentage of 20 wt % or less ensure preferable properties of the color toner.

13 Claims, 1 Drawing Sheet

COLOR TONER CONTAINING LESS CONDUCTIVE PARTICLES THAT HAVE APPROPRIATE ELECTRICAL RESISTANCE AND CAN PRODUCE CLEAR COLOR IMAGES

BACKGROUND OF THE INVENTION

1. Field of the Invention

The present invention generally relates to color toner used for electrophotography, and more particularly, to color toner that forms clear images by having a uniform conductivity and a good electrostatic charge characteristic.

2. Description of the Related Art

Electrophotography is a technique that is widely used for image forming apparatuses such as photocopiers and facsimiles. In the electrophotography technique, photoconductive insulator is usually used as described in the U.S. Pat. No. 2,297,691, for example.

An electrostatic latent image is formed by applying a photo signal provided by lasers or LEDs to the face of the photoconductive insulator that is charged by corona discharge or a charging roller.

Then, resin power called toner is adhered on the electrostatic latent images to develop a visible toner image. In the development of the toner image, the toner is charged by frictional electrification with a magnetic carrier or a blade.

The toner image is transferred to recording media such as paper or film. The toner image is, however, just "put" on the recording media. The fixing of the toner image is necessary.

As the last step, the toner on the recording media is melted by applying heat, pressure, or light, and solidified to fix the toner image on the recording media.

As described above, toner containing thermoplastic resin as the principal component is fixed on recording media by being melted and then solidified on the recording media.

Two methods are used to melt the toner: a heating roller method in which the recording media is directly heated and pressed by a heating roller and a flash fixing method in which flash light is applied to the recording media.

Recent demand for color printing requires toner that is colored by pigment and/or dye.

In the case of black toner, the toner is colored by carbon having high conductivity. Since the black toner has higher conductivity (lower resistance), the development of black toner images is easy and they are produced with little edge effect. Additionally, the black toner is not excessively charged even if it is charged repeatedly.

Compared to the black toner, the color toner does not contain carbon. Because the color toner has lower conductivity (higher resistance), the development of color toner images is rather difficult.

To eliminate this problem, conductive powder is adhered on the surface of the particle of the color toner according to a conventional technique.

Since the conductive powder, however, is not fixed on the surface of the particle of the color toner, the conductive powder easily falls off when the color toner is mixed with the magnetic carrier, for example. Consequently, the resistance of the color toner rises so that the characteristics of the developing powder changes resulting in unstable developments.

To eliminate this problem, a technique in which the conductive powder is distributed in the binding resin of the color toner so that the conductive powder does not fall off is proposed.

The problem here is that the conductive powder of more than 20 wt % must be contained in the color toner to make the resistance of the color toner low enough. Even if whitish conductive powder is generally used to avoid its effect on the color of the color toner, the color toner becomes whitish and causes the saturation of the fixed image of the recording media.

The resistance of the color toner becomes low enough if metal powder having a conductivity of less than 1 Ω·cm is used as the conductive powder distributed in the binding resin even at the weight percentage of less than 20 wt %. In this case, however, the resistance of the color toner becomes too low to charge the color toner, especially when particles of the metal powder are exposed on the surface of the particles of the color toner.

A color printer capable of printing a plurality of color toner images each corresponding to a different color must adjust development conditions such as a development bias voltage if the resistance of one color toner differs from that of another color toner.

The adjustment of the development conditions makes the control circuit of the color printer complex. The development conditions may change if color toner images are developed repeatedly. Development of color toner having uniform resistance regardless of its color is desired.

SUMMARY OF THE INVENTION

Accordingly, it is a general object of the present invention to provide a novel and useful color toner by which one or more of the problems described above are eliminated.

Another and more specific object of the present invention is to provide color toner having appropriate resistance, even if a limited weight percentage of conductive powder is contained, that can produce a color image of clear tone.

To achieve one of the above objects, a color toner for electrophotography according to the present invention, includes, binding resin, colorant, and conductive particles having an electrical resistance of 1–100 Ω·cm, an aspect ratio of equal to or more than 10, and a major axis length of equal to or less than 4 μm that are distributed in the binding resin at a weight percentage of equal to or less than 20 wt %.

According to the present invention, the color toner contains stick-shaped conductive particles having an aspect ratio of 10 or more. Compared with the related art, the conductive particles easily contact with each other and effectively reduce the resistance of the color toner even if only a small quantity of conductive particles is contained in the color toner. Accordingly, the weight percentage of the conductive particles can be reduced to 20 wt % or less, which results in a clear printed image.

The greater the aspect ratio of the conductive particles is, the less conductive particles are required in order to reduce the electrical resistance of the color toner. If the conductive particles are too long, however, the conductive particles may be exposed on the surface of a color toner particle and the color toner becomes too easily discharged. The major axis length is desired to be 4 μm or less. Furthermore, the electrical resistance of the conductive particles is desired to be 1–100 Ω·cm to ensure that the conductive particles of 20 wt % or less suffice the requirement but the resistance of the color toner is high enough.

The color toner according to the present invention as described above, is characterized in that the main component of the conductive particles is one of ZnO, $TiO_2$, $SnO_2$, $Al_2O_3$, $In_2O_3$, $SiO_2$, MgO, BaO, $MoO_3$, WO, and $MoO_3$.

Those metal oxides have a desirable resistance and less effect on the color of the color toner because of their own light colors or because they are colorless. Accordingly, clear fixed images are obtained by the development of toner images.

The color toner according to the present invention as described above, is further characterized in that the conductive particles are made of $TiO_2$ or $SnO_2$, and 50 wt % or more of the conductive particles have a major axis of equal to or more than 1 $\mu$m long and a minor axis of equal to or less than 0.1 $\mu$m.

Stick-shaped titanium oxide and/or tin oxide are, even in small quantity, are especially effective in reducing the electrical resistance of the color toner. When the conductive components contain particles having a major axis of 1 $\mu$m long or more and a minor axis of 0.1 $\mu$m long or less at a content ratio of 50 wt % or more of the total conductive particles, the effect is obvious. Accordingly, the color toner containing these conductive particles forms clear color images because of the good properties of the color toner.

The color toner according to the present invention as described above is yet further characterized in that the $TiO_2$ is coated by a coating layer made of $SnO_2$ or $Sb_2O_3$, or both.

The conductive coating layer formed on the $TiO_2$ conductive particle further reduces the required quantity of the conductive particles contained in the color toner keeping the quality of the color image at the same level.

Other objects, features, and advantages of the present invention will become more apparent from the following detailed description when read in conjunction with the accompanying drawing.

DETAILED DESCRIPTION OF THE PREFERRED EMBODIMENTS

Figure 1:
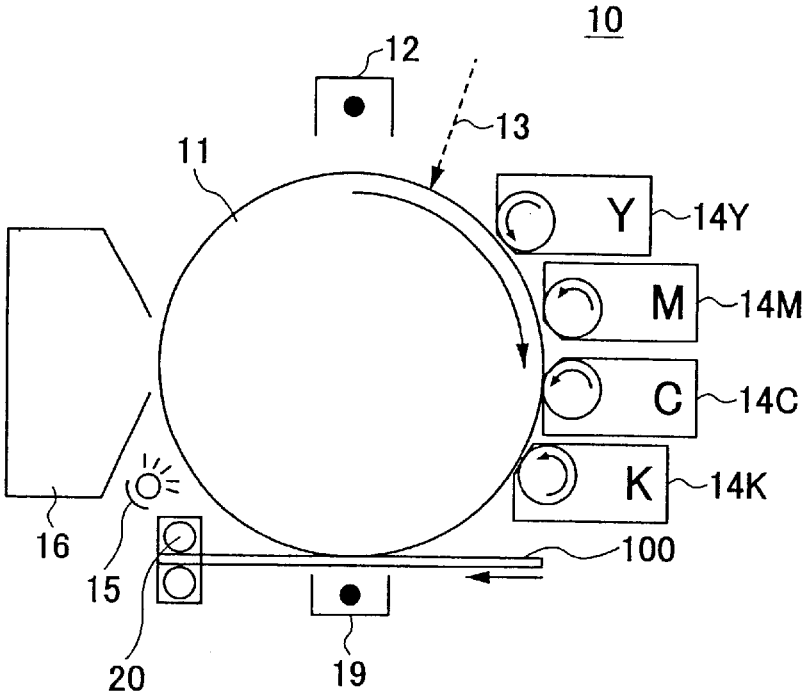
FIG. 1 is a schematic drawing showing an image forming apparatus using the color toner according to the embodiment of the present invention.

A description of the color toner according to the embodiments of the present invention will be given below.

The color toner according to the embodiment can be used with image forming apparatuses of conventional electrophotography technique such as photocopiers, printers, and facsimiles.

The color toner according to the embodiment contains, in binding resin as a base, at least colorant and conductive powder, and further contains auxiliary material such as charge control material, if necessary.

It is desired that the color of the conductive powder does not affect the color of fixed images, and its particles be stick-shaped with an aspect ratio of 10 or more. If the particles are stick-shaped, the probability of conductive powder particles touching each other is much greater than that of spherical particles of the conventional technique.

The aspect ratio is desired to be 10 or more to make the probability of touching each other higher. If the particle is too long, however, the mixing of toner and the conductive powder becomes difficult, and the risk of the conductive powder particles being exposed on the surface of a color toner particle becomes greater. The conductive powder particles are desired to be 4 $\mu$m long or less.

The conductive powder is further desired to have a resistance of 1–100 $\Omega$·cm so that the color toner can be charged at a desirable level even if the weight percentage of the conductive powder is 20 wt % or less.

One of metal oxides, ZnO, $TiO_2$, $SnO_2$, $Al_2O_3$, $In_2O_3$, $SiO_2$, MgO, BaO, $MoO_3$, WO, and $MoO_3$, for example, of which color has little effect on the color of color toners, or a mixture of more than one of them can be used as conductive powder.

Among the above metal oxides, $TiO_2$ and $SnO_2$ have the most favorable properties as conductive powder. It is desired that the conductive powder of $TiO_2$ or $SnO_2$ contains more than 50 wt % of the total conductive particles stick-shaped particles having a major axis of 1–4 $\mu$m long and a minor axis of 0.1 $\mu$m or less long to ensure that the color toner has a desirable resistance.

In the case of $TiO_2$, its surface is desired to be coated with $SnO_2$ and/or $Sb_2O_3$. The resistance of $TiO_2$ conductive powder can be controlled effectively with such conductive coating layers and the weight percentage of $TiO_2$ conductive powder is reduced.

In the case in which both $SnO_2$ and $Sb_2O_3$ are used to coat the $TiO_2$ conductive powder, the resistance of the color toner can be high enough, even if the weight percentage of $TiO_2$ conductive powder is further reduced, by containing $Sb_2O_3$ of 10 –25 wt % in the coat layer.

Similarly, in the case of $SnO_2$, its surface is desired to be coated with $Sb_2O_3$.

The other components of the color toner according to the present invention may be the same as those of conventional color toners.

Any generally available binder resin such as polyester resin, styrene-acryl resin, epoxy resin, polyether polyol resin, urethane, urea, and nylon suffices the properties required for the binder resin of the color toner according to the present invention.

Any one of publicly known colorants, monoazo system red pigment, diazo system yellow pigment, quinacridon system magenta pigment, anthraquinone dye, nigrosine system dye, quaternary ammonium salt, and monoazo system metal complex dye, for example, or a mixture of them can be used for the color toner according to the embodiment.

The following colorants can be used: aniline blue (C.I. No. 50405), chalco oil blue (C.I. No. Azoic Blue 3), chromium yellow (C.I. No. 14090), ultra marine blue (C.I. No. 77103), du pont oil red (C.I. No. 26105), quinoline yellow (CI. No. 47005), methyl blue chloride (C.I. No. 52015), phthalocyanine blue (C.I. No. 74160), malachite green oxalate (C.I. No. 42000), food red No. 2 (amaranth, C.I. No. 16185), food red No. 3 (erythrosine B, C.I. No. 45430), food red No. 40 (allura red AC, C.I. No. 16035), food red No. 102 (new coccine, C.I. No. 16255), food red No. 104 (phloxine, C.I. No. 45410), food red No. 105 (rose bengale, C.I. No. 45440), food red No. 106 (acid red 52, C.I. No. 45100), food yellow No. 4 (tartrazine, C.I. No. 19140), food yellow No. 5 (sunset yellow FCF, C.I. No. 15985), food green No. 3 (fast green FCF, C.I. No. 42053), food blue No. 1 (brilliant blue FCF, C.I. 42090), food blue No. 2 (indigo carmine, C.I. No. 73015).

The color toner according to the embodiment contains binding resin of 75–95 wt %, conductive powder of 0.1–20 wt % (preferably 1–15 wt %, more preferably 3–10 wt %), and colorant of 0.1–20 wt %.

The less conductive powder the color toner contains, the less the conductive powder affects the tone of the color toner. However, if the weight percentage of the conductive powder is too low, that is, 1 wt % or less, the effect of the addition of the conductive powder is little. The effect becomes visible when 3 wt % or more conductive powder is contained.

On the other hand, if 15 wt % or less conductive powder is contained, the tone effect on most of colors vanishes. If 10 wt % or less, no effect is found.

If necessary, charge control material may be added to the color toner according to the embodiment so that the color toner is easily charged or the charge in the color toner does not change greatly as temperature and humidity change. The charge control material is preferred to be colorless or lightly colored. Any publicly known charge control material, both positive and negative, such as quaternary ammonium salt compound, salicylate compound, boron system complex, and carboxylic system compound is usable as the charge control material.

The color toner according to the embodiment can be manufactured by publicly known conventional methods of manufacturing. Raw materials include at least binding resin, conductive powder, and colorant, and further include, if necessary, charge control material and wax. The raw materials are uniformly mixed by a pressure kneader, a roller mill, and an extruder, for example. Then, the raw materials are ground by a grinder and a jet mill, for example, and separated by a wind separator, for example.

The surface of the color toner may be additionally coated by inorganic powder that adjusts the fluidity and chargeability of the color toner. The particle of the inorganic powder is desired to be substantially spherical having a diameter of 5 nm –2 $\mu$m, more preferably, 5 nm–500 nm. The specific surface area is desired to be 20 $m^2/g$–500 $m^2/g$ by a BET method. The weight percentage of the inorganic powder in the color toner according to the embodiment is 0.1 wt %–5.0 wt %, more preferably 0.1 wt %–2.0 wt %.

The examples of the particulate inorganic powder are silica, alumina, titanium oxide, titanic acid barium, titanic acid magnesium, titanic acid calcium, titanic acid strontium, zinc oxide, silica sand, clay, mica, wollastonite, diatomite, chromium oxide, cesium oxide, red iron oxide, antimony trioxide, magnesium oxide, zirconium oxide, barium sulfate, barium carbonate, calcium carbonate, silicon carbide, and silicon nitride. The particulate silica is the most preferable among them. A hydrophobicity process is desired to be performed on the inorganic powder.

A Method of Measuring the Resistance of the Conductive Particle

A description of a method of measuring the resistance of the conductive particles contained in the color toner according to the embodiment.

A circular cylindrical body with a diameter of 20 mm and a thickness of 1–5 mm is formed by pressing the conductive powder at a pressure of 100 $kg/cm^2$. The resistance of the conductive powder (volume characteristic resistance) is calculated by the following formula and the direct current resistance of the circular cylindrical body. The resistance is measured by HV-MEASURE UNIT (KEITHLEY 237).

$$\text{resistance of conductive power } (\Omega\cdot\text{cm}) = \text{measured value} \times (\text{cross sectional area/thickness})$$

Color Toner Manufactured for Evaluation

The color toner according to the embodiment will be further explained using nine embodiments manufactured for evaluation. Ten comparative samples were also manufactured.

First Embodiment Binding resin: polyester resin (Kao) 88 wt %

Colorant: copper phthalocyanine pigment 5 wt % (Lionol Blue ES, Toyo Ink Mfr., C.I. Pigment Blue 15:3)

Negative charge control agent: E-89 2 wt % (Orient Chemical)

Conductive particle: stick-shaped titanic oxide 5 wt % (FT-1000: 8 Ω·cm, major axis length=1.7 $\mu$m, minor axis length=0.1 $\mu$m, Ishihara Sangyo)

The above raw materials are roughly mixed by a Henschel mixer and further mixed by an extruder. It is grinded by a hammer mill and fine grinded by a jet mill. After separated by a wind separator, cyan toner having volume average diameter of 8.5 $\mu$m is obtained.

Hydrophobic silica particles of 0.5 wt % (H2000/4; Clariant) are added to the cyan toner and adhered to the surface of the toner particles by a Henschel mixer. The weight percentage of the stick-shaped titanium oxide is 5 wt % as described above.

Second Embodiment

Compared with the first embodiment, magenta toner according to the second embodiment is different in the color of the colorant, the weight percentage of the binding resin, and the weight percentage of the conductive particle.

Binding resin: polyester resin (Kao) 83 wt %

Colorant: magenta pigment 5 wt % (Toner Magenta EB, Clariant)

Conductive particle: stick-shaped titanic oxide 10 wt % (FT-1000: 8 Ω·cm, major axis length=1.7 $\mu$m, minor axis length=0.1 $\mu$m, Ishihara Sangyo)

Third Embodiment

Yellow toner has been manufactured by changing the colorant of the second embodiment.

Colorant: yellow pigment 5 wt % (Toner Yellow HG, Clariant)

Fourth Embodiment

Cyan toner has been manufactured by changing the conductive particle of the first embodiment to stick-shaped tin oxide.]

Conductive particle: stick-shaped tin oxide 8 wt % (FS-10P: 70 Ω·cm, main axis length=1.5 $\mu$m, minor axis length=0.02 $\mu$m, Ishihara Sangyo)

If the above conductive particle is coated by phosphorus and tin oxide, the resistance of the conductive particle is increased up to 80–90 Ω·cm. Cyan toner having a resistance of 80–90 Ω·cm has been manufactured in this manner for comparison.

Fifth Embodiment

A magenta toner has been manufactured by changing the conductive particles of the second embodiment to titanium oxide having the following property.

Binding resin: polyester resin (Kao) 73 wt %

Colorant: magenta pigment 5 wt % (Toner Magenta EB, Clariant)

Negative charge control agent: E-89 2 wt % (Orient Chemical)

Conductive particle: stick-shaped titanic oxide 20 wt % (Resistance 10 Ω·cm, aspect ratio 10, major axis length=2 $\mu$m, minor axis length=0.2 $\mu$m)

The weight percentage of the stick-shaped titanium oxide is 20 wt %.

Sixth Embodiment

A magenta toner has been manufactured using stick-shaped titanium oxide of 5 wt % as conductive particles and the weight percentage of the binding resin has been adjusted accordingly. The other conditions are the same as the second embodiment.

Conductive particles: stick-shaped titanic oxide 5 wt % (Resistance 10 Ω·cm, aspect ratio 50, major axis length=4 μm, minor axis length=0.08 μm)

The weight percentage of the stick-shaped titanium oxide according to the sixth embodiment is 5 wt %.

Seventh Embodiment

A magenta toner has been manufactured. In comparison with the second embodiment, stick-shaped titanium oxide of 8 wt % having the following properties is used as conductive particles and the quantity of binding resin is changed. The other conditions are the same as the second embodiment.

Conductive particles: stick-shaped titanium oxide 8 wt % (Resistance: 8 Ω·cm, aspect ratio 50, containing particles that have a major axis of more than 2 μm long and a minor axis of less than 0.2 μm long at a ratio of 50 wt % to the whole titanium oxide)

The weight percentage of the stick-shaped titanium oxide is about 8 wt %.

Eighth Embodiment

A magenta toner has been manufactured in the same manner as the second embodiment except for using the stick-shaped titanium oxide having the following property and adjusting the quantity of the binding resin to make the total weight percentage 100 wt %.

Conductive particles: stick-shaped titanium oxide 5 wt %

A conductive coat layer made of tin oxide ($SnO_2$) and antimony oxide ($Sb_2O_3$) has been formed on the surface of titanium oxide particles. The weight percentage of antimony oxide ($Sb_2O_3$) is set at 10 wt %. The titanium oxide particles have a major axis of 1.7 μm long and a minor axis of 0.1 μm.

The weight percentage of stick-shaped titanium oxide according to the eighth embodiment is 5 wt %.

Ninth Embodiment

A magenta toner has been manufactured in the same manner as the eighth embodiment besides that antimony oxide $Sb_2O_3$ used for the conductive coating is 25 wt % instead of 10 wt %.

Furthermore, the following comparison samples have been manufactured.

First Comparison Sample

A magenta toner has been manufactured in the same manner as the second embodiment except that no conductive particle is used.

Second Comparison Sample

A magenta toner has been manufactured in the same manner as the second embodiment except that the conductive particles having a resistance of less than 1 Ω·cm, specifically 0.8 Ω·cm, are used.

Third Comparison Sample

The conductive particles having a resistance of more than or equal to 100 Ω·cm, specifically 120 Ω·cm and 200 Ω·cm, have been used to manufacture a magenta toner. The other conditions are the same as the second embodiment.

Fourth Comparison Sample

A magenta toner has been manufactured with conductive particles having an aspect ratio of 10 or less, of which shape is close to a sphere. Actually, two magenta toners have been manufactured based on two kinds of conductive particles, one having an aspect ratio of less than or equal to 2 and the other having an aspect ratio of less than or equal to 8. The other conditions are substantially the same as the second embodiment.

Fifth Comparison Sample

A magenta toner has been manufactured with conductive particles having a major axis of equal to or more than 4 μm long. Except that conductive particles having a major axis of 5 μm long and a minor axis of 0.1 μm long, the other conditions are the same as the second embodiment.

Sixth Comparison Sample

A magenta toner has been manufactured with conductive particles of equal to or more than 20 wt %, specifically 25 wt %. The other conditions are the same as the second embodiment.

Seventh Comparison Sample

A magenta toner has been manufactured with stick-shaped titanium oxide containing particles that have a major axis of equal to or more than 1 μm and a minor axis of equal to or less than 0.1 μm at a weight percentage of less than 50 wt %, specifically 30 wt %. The other conditions are the same as the second embodiment.

Eighth Embodiment

A magenta toner has been manufactured with titanium oxide, as conductive particles, of which surface is coated by a conductive coat layer containing antimony oxide $Sb_2O_3$ of less than 10 wt %. The coat layer is made of tin oxide ($SnO_2$) and antimony oxide ($Sb_2O_3$), in which the weight percentage of the antimony oxide is specifically 5 wt %. The other conditions are the same as the eighth embodiment.

Ninth Comparison Sample

A magenta toner has been manufactured with titanium oxide of which particles having a coat layer containing antimony oxide $Sb_2O_3$ of more than 25 wt %. The coat layer is made of tin oxide ($SnO_2$) and antimony oxide ($Sb_2O_3$), in which the weight percentage of the antimony oxide is specifically 40 wt %. The other conditions are the same as the eighth embodiment.

Tenth Comparison Sample

A color toner has been manufactured with spherical tin oxide used as conductive particles.

A magenta toner has been manufactured in the same manner as the fourth embodiment, except that spherical tin oxide particles (SN-100P, 70 Ω·cm, diameter 0.02 μm, Ishihara Sangyo) of 8 wt % has been used as the conductive particles.

Printing Tests Using the Color Toners and Tone Evaluations

Based on the nine embodiments and ten comparison samples, the following printing tests and tone evaluations have been performed.

Two-component developer is made with the above color toners of the nine embodiments and the ten comparison samples. After printing 100 thousand color images, toner specific charge, the color density of printed images, and the saturation of the printed images were examined.

Each of the above color toners of 5 wt % were mixed with silicon system resin coat magnetite carrier (Kanto Denka Kogyo) of 95 wt % by a ball mill.

The printing tests were performed by color laser printers F6708B (Fujitsu, 50 sheets per minute).

In the case of the color toners according to the nine embodiments, the change in toner specific charge was 20% or less. Clear tone images were printed in good stability.

In the case of the comparison samples 1, 3, 4, 7, 8, and 10, the color toners were excessively charged during the printing, which resulted in low image density.

In the case of the second comparison sample, printed images had defects such as fog since the resistance of the color toner was too low and its chargeability was consequently too low.

In the case of the fifth comparison sample, mixing with the other component was difficult because the major axis of the conductive particles was too long. The toner specific charge was not good, and accordingly the printed images had defects such as fog.

In the case of the sixth comparison sample, the weight percentage of the conductive particles was excessive, and accordingly, the saturation of the printed image was low.

In the case of the ninth comparison sample, because the weight percentage of $Sb_2O_3$ was too high, the conductive particles became blackish and the saturation of the printed images was low.

It is obvious from the above embodiments and comparison samples that a color toner in which conductive particles having a resistance of 1–100 Ω·cm, aspect ratio of 10 or more, a major axis of 4 μm or less long, and weight percentage of 20 wt % or less are distributed can solve problems such as fog and low saturation, which results in clear printed images.

By selecting conductive particles having suitable properties of a resistance, an aspect ratio, a major axis length, and a weight percentage, the resistance of a color toner according to the embodiments is substantially equal to that of another color toner according to the embodiments regardless of colors.

In the above embodiments, the color toners according to the embodiments were mixed with another component to form a two-component color toner. However, the color toners according to the embodiments can be used as one-component developers. If a two-component developer is preferred, conventional carriers such as not only magnetite, but also ferrite and iron powder can be used.

Next is, a description of an image forming apparatus that forms fixed images using the color toner according to the embodiments.

FIG. 1 is a schematic drawing showing a single drum type color image forming apparatus 10 that forms color images using an intermediate transfer body.

The color image forming apparatus 10 forms full color images by overlaying images printed with four respective color toners. A photo sensitive drum 11, a rotating photo conductive insulator body, is shown in the center of FIG. 1. Around the photo sensitive drum 11, a charger 12 that charges the surface of the photo sensitive drum 11 and an exposure unit 13 that forms an electrostatic latent image by exposing the surface of the photo sensitive drum 11 to a photo signal are provided. Next to the exposure unit 13, four developing units 14Y, 14M, 14C, and 14K corresponding to four color toners, yellow (Y), magenta (M), cyan (C), and black (K), respectively, that develop the electrostatic latent images are provided. Each of the developing units 14 is an independent toner cartridge that is removable. When a color toner contained in a cartridge is expended, the cartridge can be replaced independently with a new one.

A discharger 15 that discharges the surface of the photo sensitive drum 11 and a cleaner 16 that removes color toner remaining on the photo sensitive drum 11 are shown in FIG. 1. A numeral 19 indicates a transfer unit that transfers the toner images on the photo sensitive drum 11 to a piece of paper 100 and the numeral 20 indicates a fixing unit that fixes the toner images on the paper 100.

In the case of the color image forming apparatus 10, each of four developing units 14Y, 14M, 14C, and 14K forms a color toner image corresponding to the color on the photo sensitive drum 11. The four color toner images together form a full color toner image. The full color toner image is transferred to the paper 100 and fixed.

The above color image formation apparatus 10, when it is used with the color toners according to the embodiments of the present invention, reproduces clear color images without fog because only a small quantity of conductive particles are contained in the color toners. Additionally, the color toners have substantially the same resistance, which makes the control of the color image forming apparatus easy.

The fixing unit 20 shown in FIG. 1 is a roll type, but a flash type is also workable. In this case, it is desired to enhance the photo absorption efficiency of the color toners by adding infrared photo absorption agent to the color toners, for example.

The preferred embodiments of the present invention are described above. The present invention is not limited to these embodiments, but various variations and modifications may be made without departing from the scope of the present invention.

This patent application is based on Japanese priority patent application No. 2001-296645 filed on Sep. 27, 2001, the entire contents of which are hereby incorporated by reference.

What is claimed is:

1. A color toner for electrophotography, comprising:

75 to 95 wt % of binding resin;

colorant; and conductive particles each having an electrical resistance of 1–100 Ω·cm, an aspect ratio of equal to or more than 10, and a major axis length of equal to or less than 4 μm;

wherein weight percentage of said conductive particles is equal to or less than 20 wt %; and said conductive particles are distributed in said binding resin.

2. The color toner as claimed in claim 1, wherein main component of said conductive particles is one of ZnO, $TiO_2$, $SnO_2$, $Al_2O_3$, $In_2O_3$, $SiO_2$, MgO, BaO, $MoO_3$, WO, and $MoO_3$.

3. The color toner as claimed in claim 2, wherein said conductive particles are made of $TiO_2$ or $SnO_2$; and 50 wt % or more of said conductive particles have a major axis of equal to or more than 1 μm long and a minor axis of equal to or less than 0.1 μm.

4. The color toner as claimed in claim 3, wherein said $TiO_2$ is covered by a coating layer made of $SnO_2$, $Sb_2O_3$, or an alloy of $SnO_2$ and $Sb_2O_3$.

5. The color toner as claimed in claim 4, wherein said coating layer is made of said alloy of $SnO_2$ and $Sb_2O_3$, and $Sb_2O_3$ of 10–25 wt % is contained in said alloy.

6. The color toner as claimed in claim 3, wherein each of said conductive particles made of $SnO_2$ is covered by a $Sb_2O_3$ coat layer.

7. A color image forming apparatus that forms a fixed image on a recording medium, comprising:

a photo sensitive drum;

a charger;

an exposure unit; and developing units containing a color toner that comprises 75 to 95 wt % of binding resin, colorant, and conductive particles each having an electric resistance of 1–100 Ω·cm, an aspect ratio of equal to or more than 10, and a major axis length of equal to or less than 4 μm, wherein weight percentage of said conductive particles is equal to or less than 20 wt %, and said conductive particles are distributed in said binding resin.

8. A toner cartridge, comprising:

a case; and a color toner contained in said case;

wherein said color toner comprises 75 to 95 wt % of binding resin, colorant, and conductive particles each having an electric resistance of 1–100 Ω·cm, an aspect ratio of equal to or more than 10, and a major axis length of equal to or less than 4 μm, wherein weight percentage of said conductive particles is equal to or less than 20 wt %, and said conductive particles are distributed in said binding resin.

9. The color toner as claimed in claim 1 comprising 0.1 to 20 wt % of said conductive powder an 0.1 to 20 wt % of said colorant.

10. The color toner as claimed in claim 9 comprising 1 to 15 wt % of said conductive powder.

11. The color toner as claimed in claim 9 comprising 3 to 10 wt % of said conductive powder.

12. The color image forming apparatus as claimed in claim 7, wherein said color toner comprises 0.1 to 20 wt % of said conductive powder and 0.1 to 20 wt % of said colorant.

13. The toner cartridge as claimed in claim 8, wherein said color toner comprises 0.1 to 20 wt % of said conductive powder and 0.1 to 20 wt % of said colorant.

* * * * *